US006322003B1

(12) United States Patent
Haruch

(10) Patent No.: US 6,322,003 B1
(45) Date of Patent: Nov. 27, 2001

(54) AIR ASSISTED SPRAY NOZZLE

(75) Inventor: James Haruch, Naperville, IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 09/586,229

(22) Filed: Jun. 2, 2000

Related U.S. Application Data

(63) Continuation-in-part of application No. 09/330,746, filed on Jun. 11, 1999, now Pat. No. 6,161,778.

(51) Int. Cl.[7] ..... B05B 1/28

(52) U.S. Cl. ..... 239/290; 239/296; 239/298; 239/299; 239/425; 239/433

(58) Field of Search ..... 239/290, 292, 239/296, 298, 299, 419, 421, 424, 474.5, 425, 426, 432, 433, 431, 396, 545, 399, 77

(56) References Cited

U.S. PATENT DOCUMENTS

| | | | | |
|---|---|---|---|---|
| 1,587,249 | | 6/1926 | Starr . | |
| 4,516,728 | * | 5/1985 | Whinfrey | 239/433 |
| 4,537,357 | | 8/1985 | Culbertson et al. . | |
| 4,592,506 | | 6/1986 | Capes et al. . | |
| 4,646,968 | * | 3/1987 | Sablatura | 239/424 |
| 4,961,536 | | 10/1990 | Correard . | |
| 5,165,605 | | 11/1992 | Morita et al. . | |
| 5,344,078 | | 9/1994 | Fritz et al. . | |
| 5,435,491 | | 7/1995 | Sakuma . | |
| 5,549,246 | | 8/1996 | Kukesh . | |
| 5,553,783 | * | 9/1996 | Slavas et al. | 239/432 |
| 5,899,387 | | 5/1999 | Haruch . | |
| 6,098,897 | * | 8/2000 | Lockwood | 239/433 |
| 6,161,778 | * | 12/2000 | Haruch | 239/290 |

* cited by examiner

*Primary Examiner*—David A. Scherbel
*Assistant Examiner*—Dinh Q. Nguyen
(74) *Attorney, Agent, or Firm*—Leydig. Voit & Mayer, Ltd.

(57) ABSTRACT

An air assisted spray nozzle assembly adapted for more efficiently producing a full cone spray distribution with finely atomized particles distributed throughout the conical spray pattern. The spray nozzle assembly includes a nozzle body having a liquid passage communicating with the pressurized liquid supply and at least one air passage communicating with a pressurized air supply. An air cap is disposed at a downstream end of the body which includes an impingement surface against which liquid is impinged and directed radially outwardly, an expansion chamber area about the impingement surface into which radially directed liquid is further broken down and atomized by a pressurized air stream, and a plurality of circumferentially spaced axial flow passages disposed about the impingement surface and each communicating between the expansion chamber and an angularly oriented discharge orifice such that the air cap is effective for discharging a plurality of atomized liquid flow streams in an outwardly expanding conical spray pattern.

31 Claims, 2 Drawing Sheets

AIR ASSISTED SPRAY NOZZLE

RELATED APPLICATION

This application is a continuation-in-part of application Ser. No. 09/330,746 filed Jun. 11, 1999, now U.S. Pat. No. 6,161,778.

FIELD OF THE INVENTION

The present invention relates generally to air assisted spray nozzles, and more particularly, to an improved nozzle assembly for enhanced liquid particle breakdown and distribution.

BACKGROUND OF THE INVENTION

In many spray applications, such as humidification or evaporative cooling, it is desirable to generate relatively fine spray particles so as to maximize surface area for distribution in the atmosphere. For this purpose, it is known to use air assisted spray nozzle assemblies in which a pressurized gas such as air is used to break down or atomize a liquid flow stream into very fine liquid particles. For example, in some air assisted nozzle assemblies the liquid is mechanically broken down primarily in an atomizing chamber located in the nozzle assembly upstream from a spray tip or air cap which serves to form the discharging spray pattern. Alternatively, the liquid particle break down can occur in the air cap itself.

From an efficiency and economic operating standpoint it is also desirable that such particle breakdown be effected using relatively low air flow rates and pressures. Heretofore this has created problems. In particular, spray tips or air caps which provide efficient and economic operation are generally relatively complex in design, and hence relatively expensive to produce.

Additionally, these air caps are also very limited in terms of flexibility of use. For example, such air caps are typically designed so that they can only be used with a specific air assisted nozzle body configuration. Accordingly, differently configured air caps must be provided for each type of nozzle. Moreover, such air caps cannot be easily customized to discharge the liquid in different spray patterns.

Another problem with existing air assisted spray nozzles, and in particular nozzles used for spraying a coating or paint onto a surface, is that the high air pressure necessary to breakdown the fluid particles results in a high nozzle discharge pressure. This high discharge pressure often causes the particles to bounce back from the surfaces upon which they are applied. This not only can adversely affect the applied coating and create waste in material, but also can create an environmental hazard by virtue of the spray particles which are discharged into the surrounding ambient air.

Still a further problem with existing air assisted spray nozzles is that to achieve necessary atomization it often is necessary that pressurized air streams be directed against the liquid stream in a manner that produces a flat spray pattern. On the other hand, it often is desirable that the spray have an outwardly opening conical spray pattern, with finely atomized particles distributed throughout a full cone. Heretofore it has not been possible to achieve such full cone spray patterns at low air pressures, such as 10 psi.

OBJECTS AND SUMMARY OF THE INVENTION

It is an object of the present invention to provide an air assisted spray nozzle assembly which is effective for producing full cone spray patterns with enhanced liquid particle breakdown and distribution.

Another object is to provide an air assisted spray nozzle assembly of the foregoing type which provides effective atomization of fluids at relatively low air pressures.

A further object is to provide a spray nozzle assembly as characterized above which has an air cap that can be easily customized for producing a desired spray pattern.

Another object is to provide a spray nozzle assembly of the above kind which is relatively simple in design and which lends itself to economical manufacture.

Yet another object is to provide an air cap of the above kind which can be used in air assisted nozzles bodies of various designs.

These and other features and advantages of the invention will be more readily apparent upon reading the following description of a preferred exemplary embodiment of the invention and upon reference to the accompanying drawings wherein:

Figure 1:
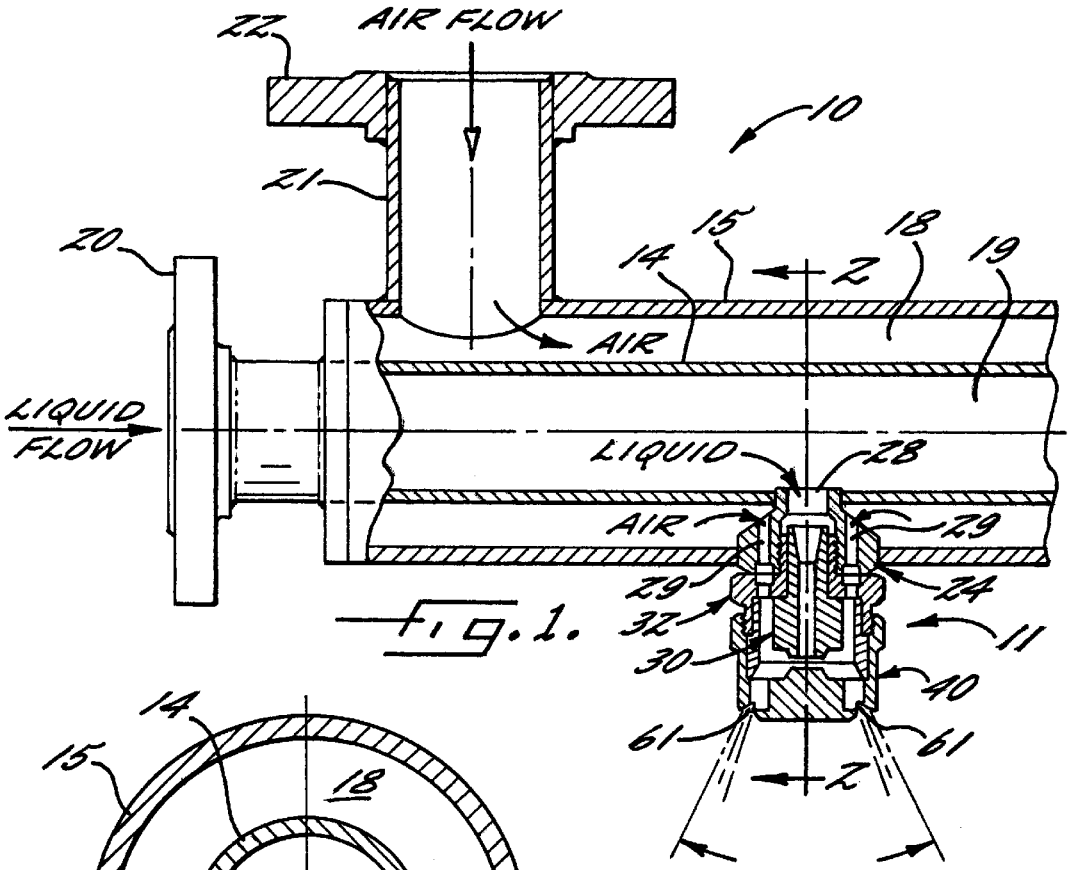
FIG. 1 is a fragmentary section of an illustrative air assisted spraying apparatus having a spray nozzle assembly in accordance with the present invention.
Figure 2:
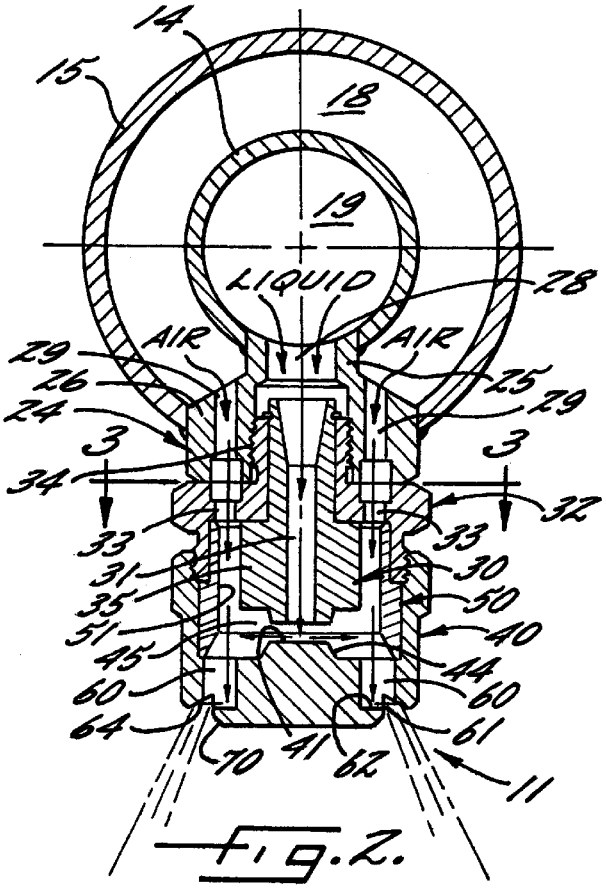
FIG. 2 is an enlarged vertical section of the illustrated spray nozzle assembly, taken in the plane of line 2—2 in FIG. 1.
Figure 3:
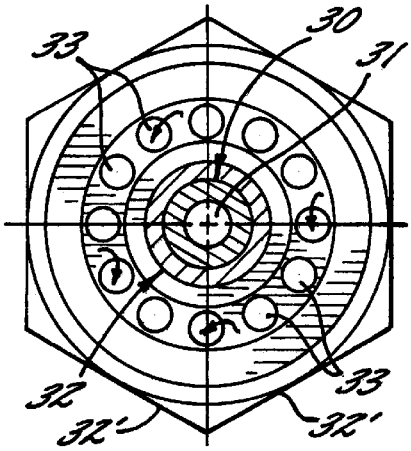
FIG. 3 is an enlarged transverse section of the illustrated spray nozzle assembly, taken in the plane of line 3—3 in FIG. 2.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown an illustrative air assisted spraying apparatus 10 having a spray nozzle assembly 11 in accordance with the present invention. The spraying apparatus 10 includes a pair of concentrically disposed manifold pipes 14, 15, which define air and liquid supply passages 18, 19. The inner manifold pipe 14 is supported at one end by a mounting flange 20 for communication with a liquid supply. The outer manifold pipe 15 has a transversely disposed inlet tube 21 supported by a mounting flange 22 for communication with an air supply, which directs air through the transverse tube 21 and into an annular air passage 18 defined between the inner and outer manifold pipes 14, 15. It will be appreciated by one skilled in the art that while a single spray nozzle assembly 11 is shown mounted in depending relation from the manifold pipes 14, 15, in practice, a plurality of similar spray nozzle assemblies 11 could be mounted in a longitudinally spaced relation along the manifold pipes 14, 15.

The illustrated spray nozzle assembly 11 includes a mounting adapter or first body member 24 having a relatively small-diameter, upstream tubular neck 25 mounted within an aperture in liquid manifold pipe 14, such as by welding, and an enlarged diameter, downstream hub 26 mounted within an aperture of the air manifold pipe 15. The upstream neck 25 has a liquid flow passage 28 communicating with the liquid manifold pipe 14. The downstream hub 26 is formed with a plurality of axial air flow passages 29 disposed in circumferential surrounding relation to the liquid passage 28, each communicating with the annular air flow passage 18.

For directing liquid through the spray nozzle assembly 11, an elongated liquid guide 30 disposed centrally within the nozzle assembly defines an axial liquid passage 31. The liquid guide 30 is mounted on an annular ring or second body member 32 which has an upstream, reduced-diameter externally threaded end 34 secured in a downstream threaded end of the adapter passage 28. The ring 32 has flats 32' to facilitate turning threaded engagement with the adapter 24. The illustrated ring 32 further is formed with a plurality of circumferentially spaced passages 33 which each communicate with a respective air passage 29 in the adaptor 24. The liquid guide 30 has an enlarged diameter downstream end portion 35 that defines a shoulder 36 for abutting engagement with a downstream end of the ring 32. The liquid guide 30 is secured to the ring 32 by an annular retaining clip 36 fixed in outwardly extending relation to an upstream end of the liquid guide 30 for engagement with an upstream end of the ring 32. The liquid guide 30 in this instance has a tapered inlet 38, with the enlarged upstream end communicating with the adapter passage 28 and a downstream end communicating with the liquid passage 31 extending through a liquid guide 30. It will be seen that liquid communicated to the inner manifold pipe 14 will be directed through the adapter passage 28 and liquid guide passage 31 for discharge from a downstream end of the liquid guide passage 31.

To break up and preliminarily atomize liquid discharging from the liquid guide 30, an air cap or spray tip 40 is provided which has an impingement surface 41 disposed in closed transverse relation to the end of the liquid guide passage 31. For securing the air cap 40 in assembled position, the air cap 40 has an internally threaded upstream end portion 42 which is screwed onto an externally threaded downstream end portion of the ring or second body member 32. The impringement surface 41 in this instance is defined by an upwardly extending, integral protrusion 44 of the air cap 40. Pressurized liquid discharging from the liquid guide passage 31 will impinge upon the surface 41 and be directed radially outwardly thereof in all circumferential directions into an annular expansion chamber 45 about the impingement surface 41.

For further breaking down and atomizing liquid directed radially outwardly of the impingement surface 41, an annular pressurized stream of air is directed axially along the outer perimeter of the liquid guide 30. In the illustrated embodiment, an outer annular air guide 50 is mounted in concentric relation to the liquid guide 40 for defining an annular air flow passage 51 therebetween. The air guide 50 is supported between a downwardly opening counterbore 52 of the ring 32 and an upwardly opening counterbore 54 of the air cap 40. The expansion chamber 45 about the impingement surface 41 in this case is defined by a recessed inner wall 55 of the air cap 40 about the protrusion 44, a recessed bottom wall 56 of the liquid guide 30 about the passage 31, and an inner wall of the air guide 50. The upstream end of the air guide 50 has an outwardly extending chamfer 58 to facilitate direction of air from the inlet passages 29, 33 into the annular air passage 51, and the downstream end of the air guide has a chamfer 59 for directing atomized liquid through to the air cap 40. It will be understood that while in the illustrated embodiment separate liquid and air guides 30, 50 are shown, alternatively, the liquid and air guides 30, 50 could be formed as a single component of the nozzle body assembly.

In accordance with the invention, the spray nozzle assembly is adapted for further efficient liquid atomization and for the outward direction of finely atomized liquid into a conical spray pattern. To this end, the air cap 40 has a plurality of circumferentially spaced axial flow passages 60 communicating between the expansion chamber 45 and respective discharge orifices 61 of the air cap. The axial flow passages 60 in this case each have a cylindrical configuration and are uniformly located in circumferentially spaced relation about the impingement surface 41 and the perimeter of the expansion chamber 45. The axial flow passages 60 each terminate in a flat bottom wall 62 perpendicular to the flow axis, and each discharge orifice 61 communicates through the axial flow passage 60 adjacent the bottom wall 62. In the illustrated embodiment, each discharge orifice 61 extends through a portion of the bottom wall 62 and an outer side of each axial flow passage 60. It will be seen that pre-atomized liquid directed by the pressurized air stream axially into the passages 60 will to a large extent impinge on the end walls 62 of the passageways for further liquid particle breakdown and atomization, and then be directed in a downward and radially outward direction through the discharge orifices 61

Figure 4:
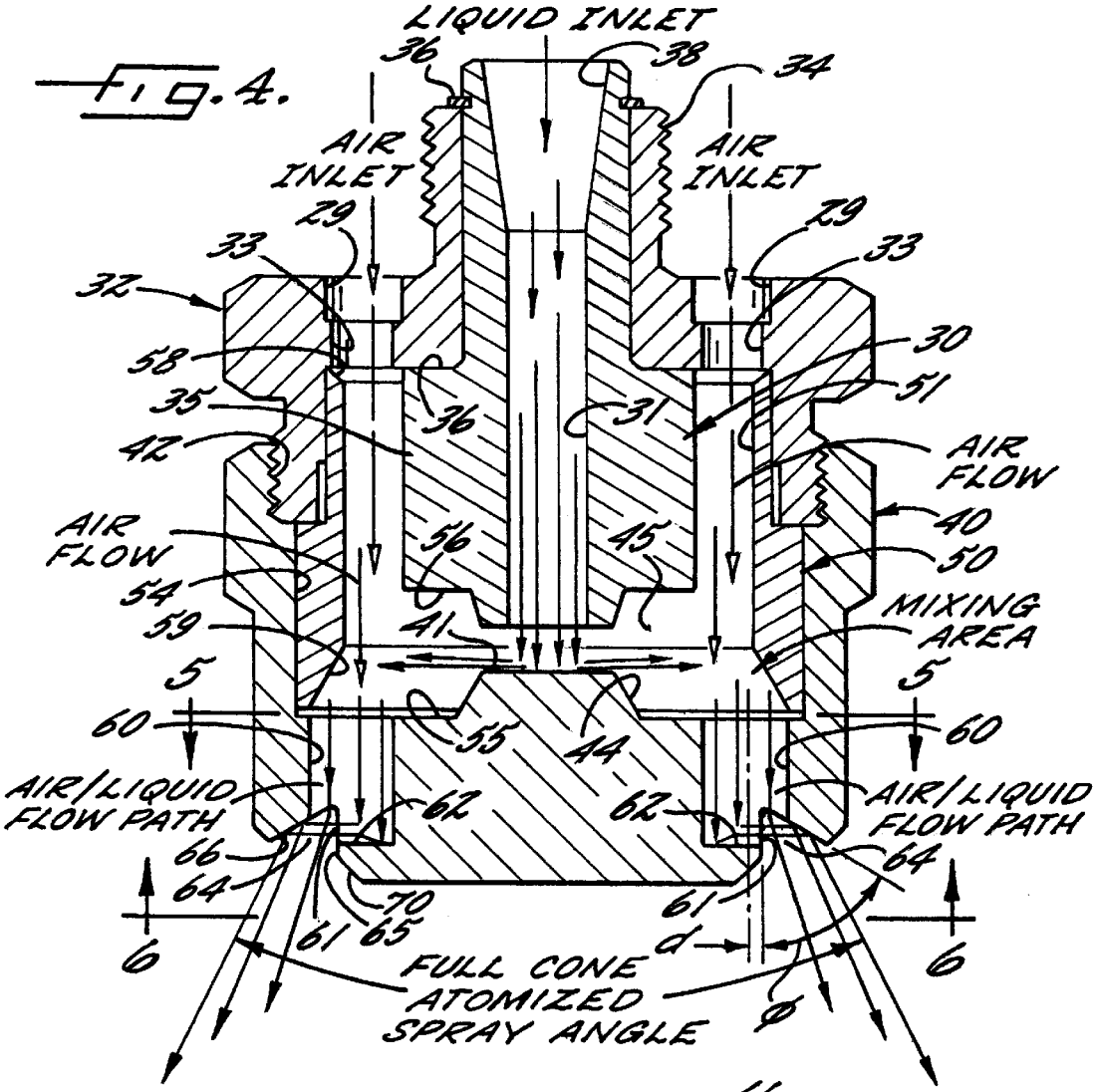
FIG. 4 is an enlarged section of the illustrated spray nozzle assembly.

In carrying out the invention, the discharge orifices 61 are formed for directing a plurality of circumferentially spaced streams of atomized liquid particles in a manner which forms a conical discharge spray with particles distributed throughout the conical pattern. For this purpose, the discharge orifices 61 each are formed by an angled cut 64 in the end of the air cap 40 defined by a cylindrical side wall 65 parallel to the nozzle axis and an angled side wall 66 formed by a conical surface (FIG. 4). In the illustrated embodiment, the cylindrical and conical side walls 65, 66 define an angle $\phi$ of about 60°, as depicted in FIG. 4.

Figure 5:
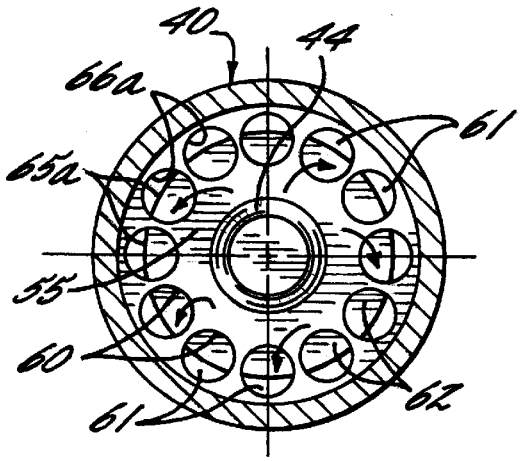
FIG. 5 is a reduced size transverse section of the illustrated spray nozzle, taken in the plane of line 5—5 in FIG. 4.
Figure 6:
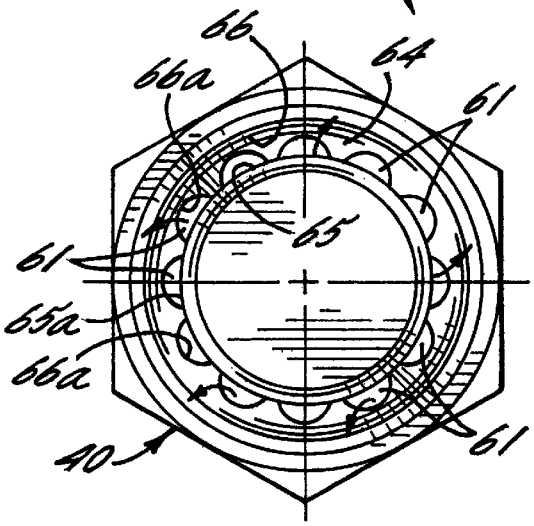
FIG. 6 is a reduced size bottom view of the illustrated spray nozzle, taken in the plane of line 6—6 in FIG. 4.

Preferably the discharge orifices 61 are defined by forming the angled cut 64 in circular fashion completely around the bottom end of the air cap so as to intersect each of the axial passages 60 and thereby form a respective discharge orifice 61 for each passage 60 which enables both downward and radially outward direction of each discharging atomized liquid flow stream, as well as lateral expansion of the flow stream. As depicted in FIGS. 4–6, the circular cut 64 in effect defines an annular channel in the end of the air cap 41, with the cylindrical and conical side walls 65, 66 directing the discharging flow stream downwardly and radially outwardly so as to create a conical pattern. As depicted in FIGS. 5 and 6, the discharge orifices 61 each have a half moon configuration, having a radially inward curved side **65*a* defined by the cylindrical side wall 65 of the cut 64 and a radially outer side 66*a* defined by the intersection of the conical side wall 66 and cylindrical side wall of the axial passage 60. The side wall 66*a* of each discharge orifice in this case has a significantly smaller radius of curvature than the curvature defined by the cylindrical side wall 65. The cylindrical side wall 65 of the angled cut 64 preferably extends into the end of the air cap 40 at a location radially outwardly of the axes of the passages 60, such as by a distance "d", as depicted in FIG. 4, thereby creatinig a relative large bottom wall deflection surface 62. To permit radial inward expansion of discharging streams of atomized particles from the orifices 61, the cylindrical side wall 65 of the circular cut 64 has a chamfer 70 that extends downwardly and radially inwardly. The channel defined by the circular cut 64** thereby permits radial expansion of the discharging flow streams such that the liquid particles completely fill in the conical form defined by the plurality of circumferentially spaced discharging streams in order to create a full cone spray pattern with substantial uniformity in liquid particle distribution.

Moreover, it has been found that the spray nozzle assembly 11 of the present invention is effective for discharging such full cone spray patterns with improved atomization, while operating at relatively low air pressures and liquid flow rates. In practice, effective full cone spraying has been achieved at air pressures of 10–15 psi at a liquid flow rate of 10 gpm.

From the foregoing, it will be understood by one skilled in the art that the spray nozzle assembly 11 of the present invention, and particularly the air cap 40, is adapted for economical and versatile manufacture. Indeed, the air cap 40 can be machined of metal in relatively simple and precise machining steps. Moreover, spray characteristics defined by the air cap 40 can easily be altered and adjusted for particular spray applications, by alternating the number and spacing of the axial air flow passages 60 and/or the angle and size of the circular cut that defines the angled discharge orifices 61. Preferably, the air cap has between about 8 and 12 equally spaced discharge orifices. The spray nozzle assembly, therefore, is not only adapted for efficient and economic operation, it also lends itself to economical production and can be designed for particular spray applications. The air cap furthermore can be used with air assisted spray nozzle bodies of various designs.

What is claimed is:

1. An air assisted spray nozzle assembly comprising:

a nozzle body having at least one air passage for connection to a pressurized air supply and a liquid passage for connection to a pressurized liquid supply, said liquid passage extending axially through said body and having a discharge end through which pressurized liquid from said liquid supply is directed, an air cap disposed at a downstream end of said body, said air cap defining an impingement surface disposed in spaced relation to the discharge end of said liquid passage transversly to liquid directed through said liquid passage for deflecting liquid impinging thereon in a radially outward direction 360° with respect to the impingement surface to preliminarily break down said liquid flow stream into liquid particles, said air cap defining an annular expansion chamber about said impingement surface for receiving the liquid particles directed radially outwardly from said impingement surface, said at least one air passage being effective for directing pressurized air about said impingement surface for further breaking down and atomizing liquid deflected radially from said impingement surface, said air cap being formed with a plurality of axial flow passages disposed in circumferentially spaced relation about said impinging surface, said air cap flow passages each having a flow axis parallel to said axial liquid passage, said air cap flow passages each defining a flat deflection surface at a downstream end thereof, and said air cap flow passages each having a respective discharge orifice adjacent the deflection surface thereof for discharging a plurality of atomized liquid flow streams from the air cap in an outwardly expanding conical spray pattern.

2. The air assisted spray nozzle assembly of claim 1 in which said discharge orifices each extend in part through the flat deflection surface defined by the axial flow passage.

3. The air assisted nozzle of claim 1 in which said discharge orifices each extend in part through the deflection surface defined by the axial flow passage and in part through an outer side wall of the axial flow passage.

4. The air assisted spray nozzle assembly of claim 3 in which said expansion chamber has an annular configuration, and said at least one air passage directs pressurized air into said expansion chamber for further breaking up and atomizing liquid radially directed from said impingement surface.

5. The air assisted spray nozzle assembly of claim 1 in which said discharge orifices each are defined by an angled cut intersecting each said axial flow passage of said air cap.

6. The air assisted spray nozzle assembly of claim 1 in which each said orifice defining angled cut is defined by an inner cylindrical side wall parallel to the axis of said flow passages and an outer conical side wall extending radially outwardly in a downstream direction.

7. The air assisted spray nozzle assembly of claim 6 in which said cylindrical and conical side walls define an angle of about 60°.

8. The air assisted spray nozzle assembly of claim 6 in which the inner side wall of each discharge orifice terminates with an angled surface that extends radially inwardly in the downstream direction.

9. The air assisted spray nozzle assembly of claim 5 in which said angular cut is a circular cut that defines a channel in the end of said air cap that intersects each of said axial flow passages.

10. The air assisted spray nozzle assembly of claim 1 in which said liquid passage is defined by a separate liquid guide mounted within said body, and said air passage is defined at least in part between said liquid guide and a concentrically disposed air guide mounted within said body.

11. An air assisted spray nozzle assembly comprising:

a nozzle body having at least one air passage for connection to a pressurized air supply and a liquid passage for connection to a pressurized liquid supply, said liquid passage extending axially through said body and having a discharge end through which pressurized liquid from said liquid supply is directed, an air cap disposed at a downstream end of said body, said air cap defining an impingement surface in spaced relation to the discharge end of the liquid passage and an expansion chamber surrounding the impingement surface, said impingement surface being disposed in transverse relation to liquid directed through the discharge end of said liquid passage against which the liquid impinges and is directed radially outwardly 360° with respect to the impingement surface into the surrounding expansion chamber, said at least one air passage being effective for directing pressurized air about said impingement surface for further breaking down and atomizing liquid directed radially outwardly from said impingement surface into said expansion chamber, said air cap being formed with a plurality of axial flow passages disposed in circumferentially spaced relation about said impinging surface, said air cap flow passages each having a flow axis parallel to said axial liquid passage, and said air cap flow passages each having a respective discharge orifice defined by an angled opening for discharging a plurality of atomized liquid flow streams from the air cap in an outwardly expanding conical spray pattern.

12. The air assisted spray nozzle assembly of claim 11 in which said expansion chamber has an annular configuration, and said at least one air passage directs pressurized air into said expansion chamber for further breaking up and atomizing liquid radially directed from said impingement surface.

13. The air assisted spray nozzle assembly of claim 11 in which each said orifice defining angled cut is defined by an inner cylindrical side wall parallel to the axis of said flow passages and an outer conical side wall extending radially outwardly in a downstream direction.

14. The air assisted spray nozzle assembly of claim 13 in which the inner side wall of each discharge orifice terminates with an angled surface that extends radially inwardly in the downstream direction.

15. An air assisted spray nozzle assembly comprising:

a nozzle body having at least one air passage for connection to a pressurized air supply and a liquid passage for connection to a pressurized liquid supply, said nozzle body defining a mixing and expansion chamber into which pressurized liquid and air directed from said liquid passage and at least one air passage intermix causing breakdown and atomization of the liquid, an air cap disposed downstream of said body, said air cap having a plurality of circumferentially spaced axial flow passages having a flow axis parallel to a central axis of said air cap, said air cap flow passages each defining a flat deflection surface perpendicular to the flow axis at a downstream end thereof against which at least a portion of the atomized liquid impacts as it is directed through said flow passage, and said air cap flow passages each having a discharge orifice adjacent the deflection surface for discharging an atomized liquid flow stream in a direction radially outwardly with respect to the flow axis whereby said plurality of discharge orifices discharge a plurality of atomized liquid flow streams from said air cap in an outwardly expanding full cone spray pattern with liquid particles distributed throughout the spray pattern.

16. The air assisted spray nozzle assembly of claim 15 in which said air cap is formed with a plurality of axial flow passages each communicating with a respective one of said discharge orifices.

17. The air assisted spray nozzle assembly of claim 16 in which said axial flow passages each define a flat deflection surface at a downstream end thereof for deflecting and further breaking down liquid particles prior to direction through said discharge orifices.

18. The air assisted spray nozzle assembly of claim 15 in which said discharge orifices each are defined by an angled cut intersecting each said axial flow passage of said air cap.

19. The air assisted spray nozzle assembly of claim 18 in which each said orifice defining angled cut is defined by an inner cylindrical side wall parallel to an axis of said air cap and an outer conical side wall extending radially outwardly in a downstream direction.

20. The air assisted spray nozzle assembly of claim 19 in which said angular cut is a circular cut that defines a channel in the end of said air cap that intersects each of said axial flow passages.

21. The air assisted spray nozzle assembly of claim 19 in which said cylindrical and conical side walls define an angle of about 60°.

22. The air assisted spray nozzle assembly of claim 19 in which the inner side wall of each discharge orifice terminates with an angled surface that extends radially inwardly in the downstream direction.

23. An air assisted spray nozzle assembly comprising:

a nozzle body having at least one air passage for connection to a pressurized air supply and a liquid passage for connection to a pressurized liquid supply, said nozzle body defining a mixing and expansion chamber into which pressurized liquid and air directed from said liquid passage and at least one air passage intermix causing breakdown and atomization of the liquid, an air cap disposed downstream of said body, said air cap having a plurality of circumferentially spaced discharge orifices each angularly oriented with respect to a central axis, said discharge orifices each having a half moon configuration defined by a first inner curved side wall and a second outer curved side wall having a radius of curvature smaller than the curvature of said first side wall, and said discharge orifices being effective for directing a plurality of atomized liquid flow streams from said air cap in an outwardly expanding full cone spray pattern with liquid particles distributed throughout the spray pattern.

24. The air assisted spray nozzle assembly of claim 23 which each said discharge orifice is defined by an inner cylindrical side wall parallel to an axis of said air cap and an outer conical side wall extending radially outwardly in a downstream direction.

25. The air assisted spray nozzle assembly of claim 24 in which the inner side wall of each discharge orifice terminates with an angled surface that extends radially inwardly in the downstream direction.

26. A spray apparatus comprising a liquid manifold pipe coupled to a pressurized liquid supply, an air manifold pipe mounted in concentric relation about said liquid manifold pipe for defining an annular air passage therebetween for connection to a pressurized air supply, a spray nozzle assembly comprising a nozzle body including an adapter having a first portion mounted in said liquid manifold pipe and being formed with a liquid passage in communication with said liquid manifold pipe, said adapter having a second portion mounted in said air manifold pipe and being formed with at least one air flow passageway in communication with said annular air passage, said nozzle body defining a mixing and expansion chamber into which pressurized liquid and air directed from said liquid passage and at least one air flow passage intermix causing breakdown and atomization of the liquid, an air cap disposed downstream of said body, said air cap having a plurality of circumferentially spaced discharge orifices each angularly oriented with respect to a central axis of said air cap for discharging a plurality of atomized liquid flow streams from said air cap in an outwardly expanding full cone spray pattern with liquid particles distributed throughout the spray pattern.

27. The air assisted spray nozzle assembly of claim 26 in which said air cap is formed with a plurality of axial flow passages each communicating with a respective one of said discharge orifices.

28. The air assisted spray nozzle assembly of claim 27 in which said axial flow passages each define a flat deflection surface at a downstream end thereof for deflecting and further breaking down liquid particles prior to direction through said discharge orifices.

29. The air assisted spray nozzle assembly of claim 26 in which each said orifice is defined by an inner cylindrical side wall parallel to an axis of said air cap and an outer conical side wall extending radially outwardly in a downstream direction.

30. An air assisted spray nozzle assembly comprising:

a nozzle body having at least one air passage for connection to a pressurized air supply and a liquid passage for connection to a pressurized liquid supply, said liquid passage extending axially through said body and having a discharge end through which pressurized liquid from said liquid supply is directed, an air cap disposed at a downstream end of said body, said air cap defining an impingement surface disposed transversly to liquid directed through said liquid passage for deflecting liquid impinging thereon in a radially outward direction, said at least one air passage being effective for directing pressurized air about said impingement surface for further breaking down and atomizing liquid deflected radially therefrom, said air cap being formed with a plurality of axial flow passages disposed in circumferentially spaced relation about said impinging surface, said air cap flow passages each having a flow axis parallel to said axial liquid passage, said air cap flow passages each defining a flat deflection surface at a downstream end thereof, said air cap flow passages each having a respective discharge orifice adjacent the deflection surface thereof for discharging a plurality of atomized liquid flow streams from the air cap in an outwardly expanding conical spray pattern, and said discharge orifices each having a half moon configuration defined by a curved inner side wall and an outer side wall having a radius of curvature smaller than the first side wall.

31. An air assisted spray nozzle assembly comprising:

a nozzle body having at least one air passage for connection to a pressurized air supply and a liquid passage for connection to a pressurized liquid supply, said liquid passage extending through said body and having a discharge end through which pressurized liquid from said liquid supply is directed, an air cap disposed at a downstream end of said body, said air cap defining an impingement surface in spaced relation to the discharge end of the liquid passage and an expansion chamber surrounding the impingement surface, said impingement surface being disposed in perpendicular relation to liquid directed through the discharge end of said liquid passage against which the liquid impinges and is radially directed into said expansion chamber, said at least one air passage being effective for directing pressurized air about said impingement surface for further breaking down and atomizing liquid directed radially outwardly from said impingement surface into said expansion chamber, said air cap being formed with a plurality of flow passages disposed in circumferentially spaced relation about said impinging surface, said flow passages each having a flow axis parallel to a central axis of said air cap, said flow passages each defining a flat deflection surface perpendicular to the flow axis at a downstream end thereof, and said air cap flow passages having a respective discharge orifice adjacent the deflection surface thereof for discharging a plurality of atomized liquid flow streams from the air cap in an outwardly expanding full cone spray pattern with liquid particles distributed throughout the spray pattern.

* * * * *